United States Patent [19]

Allan

[11] 4,118,159

[45] Oct. 3, 1978

[54] ROTARY PISTON MACHINE

[76] Inventor: John Allan, Skanor, West Hill, Bembridge, Isle of Wight, England

[21] Appl. No.: 634,065

[22] Filed: Nov. 21, 1975

[51] Int. Cl.[2] ..... F04C 5/00

[52] U.S. Cl. ..... 418/153; 418/187; 418/185

[58] Field of Search ..... 418/153, 154, 156, 187, 418/188

[56] References Cited

U.S. PATENT DOCUMENTS

| | | | |
|---|---|---|---|
| 631,701 | 8/1899 | Du Bois | 418/156 X |
| 1,086,488 | 2/1914 | Wachter | 418/156 |
| 3,544,243 | 12/1970 | Stageberg | 418/156 X |
| 4,004,865 | 1/1977 | Ikeda et al. | 418/153 |

FOREIGN PATENT DOCUMENTS

| | | | |
|---|---|---|---|
| 630,507 | 12/1927 | France | 418/156 |
| 857,530 | 12/1960 | United Kingdom | 418/154 |

*Primary Examiner*—Carlton R. Croyle
*Assistant Examiner*—Leonard Smith

[57] ABSTRACT

The specification discloses a rotary machine, providing internal compression or expansion, connectable to a driving or driven shaft and comprising a cylinder rotatable about its axis, a piston within the cylinder rotatable, synchronously with the cylinder, about an axis parallel to but offset from the axis of rotation of the cylinder, cylinder end boundaries contiguous with either the cylinder or the piston, and a series of flexible vanes each of which is insealable rubbing contact with the end boundaries and is sealably connected to the circumferential surfaces of the cylinder and piston, whereby rotation of the cylinder or piston is transmitted by the pull of the vanes to the piston or cylinder, the volume between each adjacent pair of vanes alternately increasing and decreasing during induction and exhaust of the said volume.

21 Claims, 24 Drawing Figures

"P"
"e"

ROTARY PISTON MACHINE

This invention relates to rotary piston machines, and especially to machines such as liquid pumps, fans, blowers, gas compressors, air motors, vapour and hot gas engines which comprise a cylinder rotatable about its axis and, within the cylinder, a piston rotatable about an axis parallel to, but offset from, the cylinder axis, a series of flexible vanes being connected between the outer periphery of the piston and the inner surface of the cylinder.

There have in the past been several proposals for flexible vane machines to compete with the familiar sliding vane pump and motor but few of these have led to practical results. Generally, the problems of vane edge sealing, end plate sealing, abutment between high and low pressure parts of the cycle, cooling, fatigue of materials, and the attainment of a usefully high compression or expansion ratio have been left unmentioned. None of the published proposals has been to a geometry similar to that of this invention which particularly exploits the low rubbing speed at sealing faces obtainable from the synchronous rotary motions of both the cylinder and piston. Only in very recent times have materials been available to carry this type of machine to a practical design.

According to the present invention there is provided a rotary machine, providing internal compression or expansion, connectable to a driving or driven shaft and comprising a cylinder rotatable about its axis, a piston within the cylinder rotatable, synchronously with the cylinder, about an axis parallel to but offset from the axis of rotation of the cylinder, cylinder end boundaries contiguous with either the cylinder or the piston, a series of flexible vanes, controlled in deflection by geometrical and pressure changes, each of which is, without recourse to liquid additives, in sealable, rubbing contact with the end boundaries, and is sealably connected to the circumferential surfaces of the cylinder and piston, whereby rotation of the cylinder or piston is transmitted by the pull of the vanes to the piston or cylinder respctively, each vane sweeping the space between the said circumferential surfaces and the end boundaries in each revolution, each pair of adjacent vanes defining, with the said circumferential surfaces and the end boundaries, a chamber for a fluid medium, ports in the cylinder and/or piston and/or end boundaries which are opened or closed by a valve or valves to control entry and/or exhaust of said fluid medium, and means for preventing the flow of fluid from one chamber to another chamber.

On rotation of the cylinder and the piston, each fluid medium chamber, formed between adjacent vanes, will expand from a minimum volume at the bottom dead centre position (BDC), i.e. where the piston and cylinder surfaces are at their closest, to a maximum volume in the region of the top dead centre position (TDC), i.e. where the piston and cylinder surfaces are at their farthest apart, and will contract again between this point and the RDC. Thus, fluid entrained into a chamber in the BDC-TDC part of the cycle may be compressed in the TDC-BDC part of the cycle and, by suitable arrangements of valves, a continuous process of ingestion, compression and discharge will result. Alternatively the cycle may be of an expansive and exhausting form as is suitable for an air motor or vapour engine.

The machine of the invention is suitably one where the expansion of compression ratio is at least six, and such a ratio may be achieved by arranging for the gap between the piston and the cylinder, at its smallest, to be less than 5% of the mean internal diameter of the cylinder; or alternatively by a somewhat complex construction of the facing surfaces of the piston and cylinder, e.g. making those surfaces polygonal and the formation of lobes and troughs thereon, such as will be described in more detail hereinafter. The machine is especially one where partial or complete sealing between the fluid medium chambers is obtained without recourse to oils or other liquids.

The rotary motion of the piston is especially synchronous with that of the cylinder under the timing of gears or nearly so when the motion is controlled only by the vanes themselves. Drive may be imparted to or by the machines via the cylinder, or alternatively the piston may be the driven or driving member.

In a modification of the invention the cylinder is fixed relatively to ground, without change to the relative motions within the machine, and the offset piston, having also zero rotation, relative to ground, is caused to generate an orbital path about the cylinder axis, for example on rotation of a cranked axle. In the following description, however, reference will only be made, for the sake of clarity, to machines having rotating cylinders and pistons but it should be borne in mind that the considerations described are equally applicable to the modification.

Now, whereas the pumping action of the machines of this invention is not geometrically dependent on the maintenance of a rigid abutment between high and low pressure zones in the BDC region, it is preferable that such be provided, with the associated positive gearing of piston and cylinder motions, when the pressure differences are significant and are such as would reverse the curvature of the vanes were no abutment provision made.

The vanes are preferably constructed from a pliant sheet material capable of repeated flexing and of being rendered impervious, e.g. a coated fabric, and, in their motion, vary from an approximately flat shape, in the low pressure region to a doubled form at the high pressure point of the cycle, and wrap along the surfaces of the piston and cylinder without rub except at the end plates which, themselves rotating, confine this rub to that travel from local orbiting and changing vane profile. The machine then has a very low frictional loss and yet the sealing is perfect at the attachments to the cylinder and piston and efficient at the end plates. Because the cylinder is rotating, the maximum compression and heat generation is given to each compartment in turn and so the whole surface area of the cylinder is available for cooling and is of even temperature.

The load carrying material of the vanes is typically a fibrous fabric, rendered impervious by an elastomeric coating, and as may be formed from carbon, glass, metal or organic fibres. Alternatively the vane may be formed of a synthetic elastomer, optionally reinforced with inorganic or organic synthetic fibrous filaments. The elastomer may be enriched with a low friction additive such as carbon, polytetrafluoroethylene or molybdenum disulphide. Sealing at the end plates is also enhanced if the vanes are cut in the flat to have a barrel shape so that, when the curved ends are drawn to the straight, in order to be fitted into the machine, a "balloon segment" contour is formed.

Alternatively, the vane may be of flat material, cut slightly over length, axially, so that when folded, the surface tends to buckle. When such a vane is stiffened by axial battens or teeth, with discontinuities near to but not at the vane ends the buckling may be localised at such a break in stiffening. Under pressure, the buckles smooth out and an axial force is generated in the stiffening, local to the vane ends, to load the edge reinforcing bead against the chamber boundary or end plate and render effective sealing. Following the axially disposed batten or tooth concept still further, the vane may become virtually an articulated structure in having a number of rods or plates as splines which may be linked to form a chain with flexural freedom in the radial direction and to provide a matrix for the addition of an impervious, heat resistant coating.

The invention will now be described in somewhat greater detail with reference to the accompanying diagrammatic drawings, in which.

Figure 7:
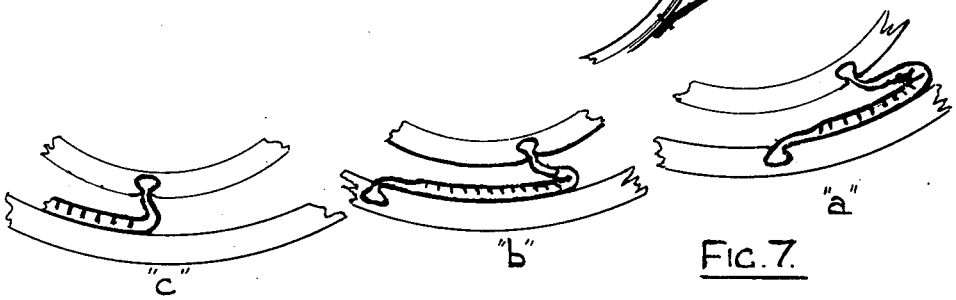
Figure 9:
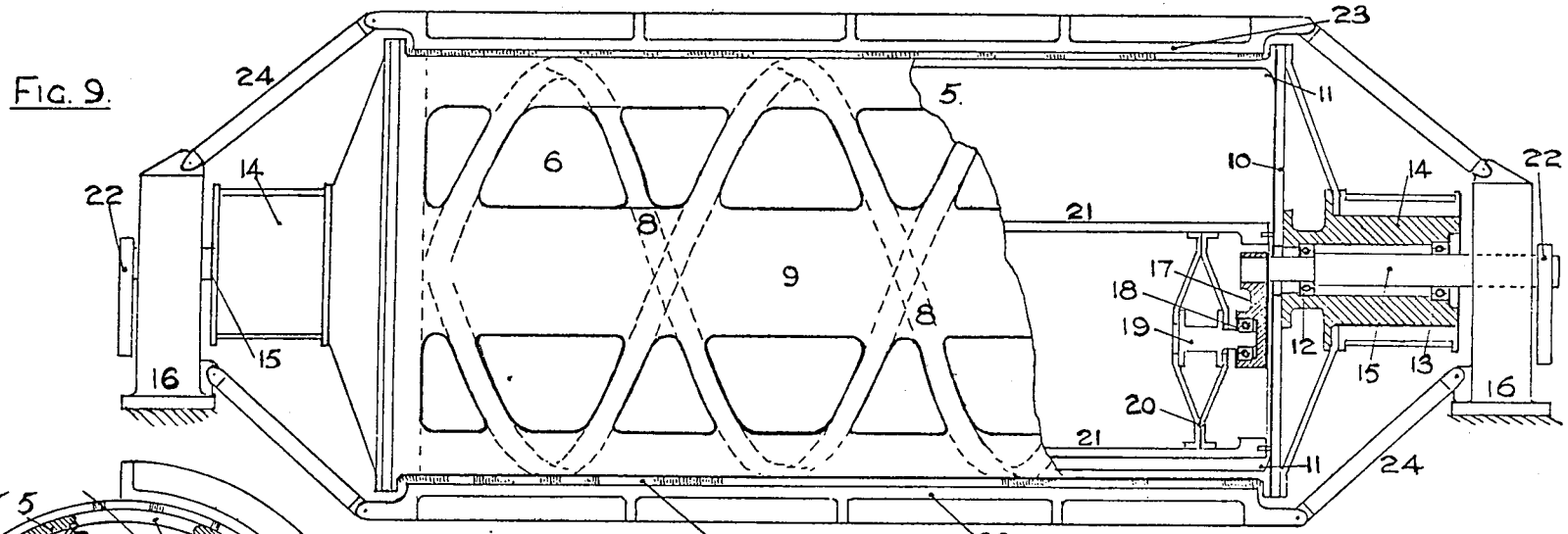
Figure 10:
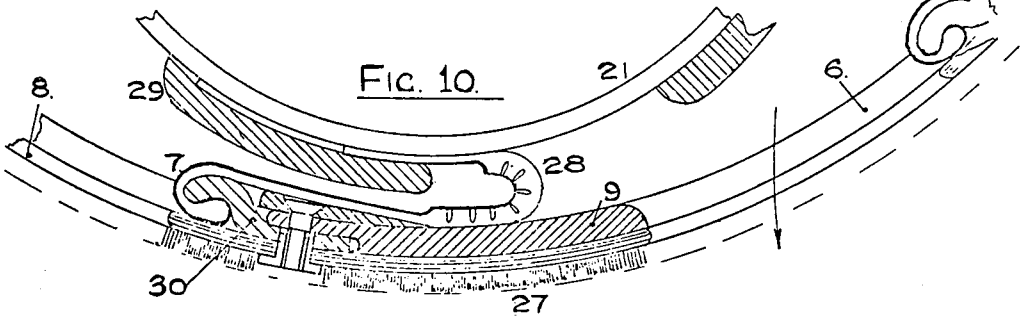
Figure 8:
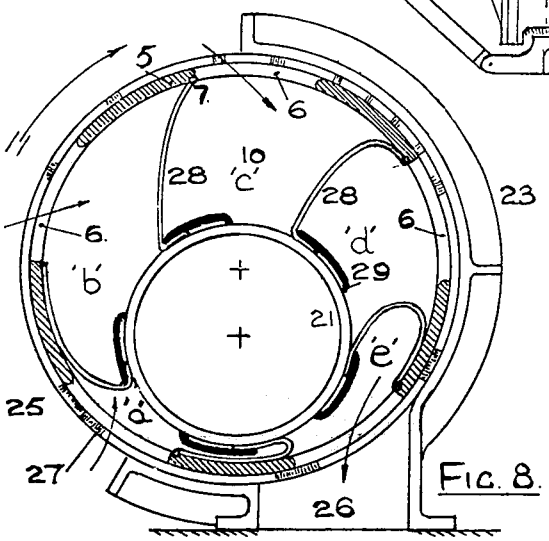
Figure 13:
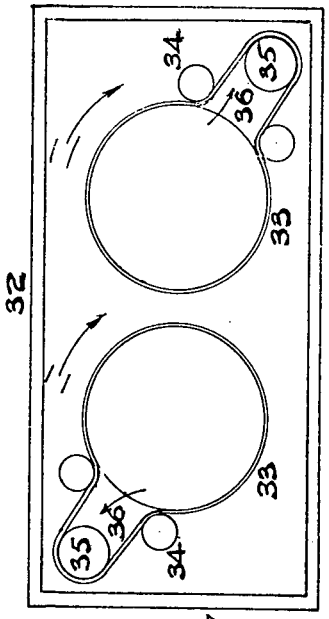
Figure 11:
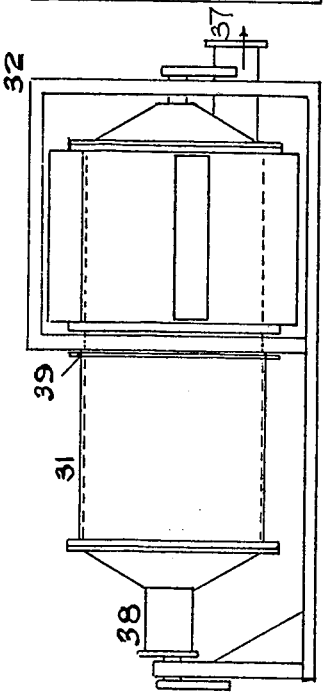
Figure 12:
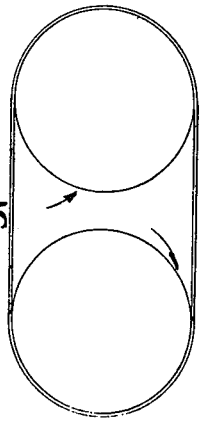
Figure 15:
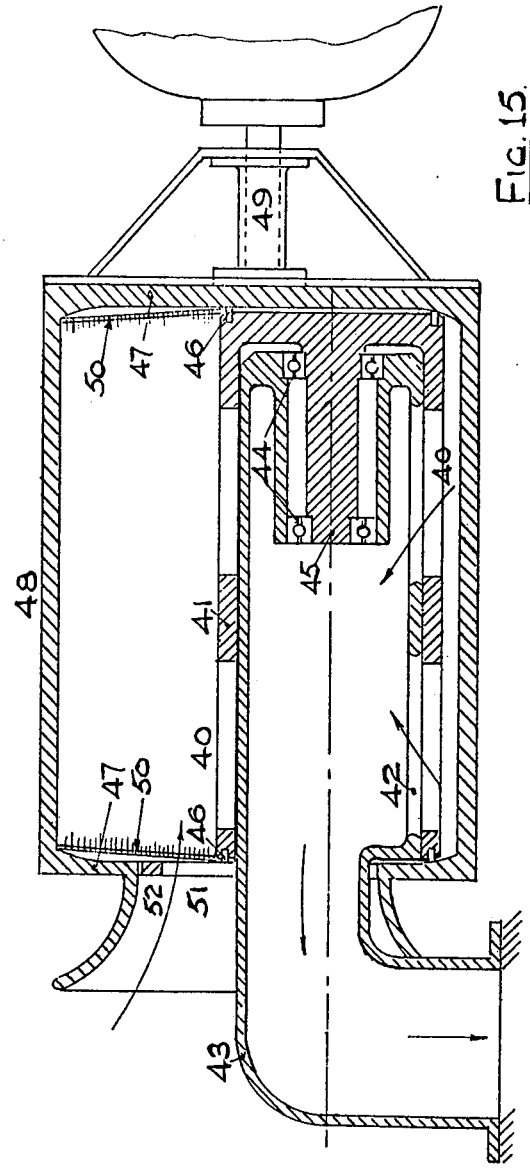
Figure 14:
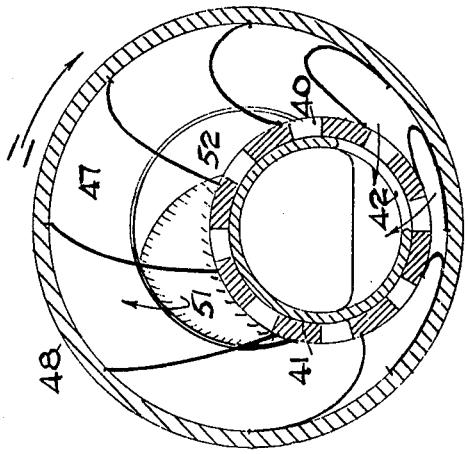
Figure 17:
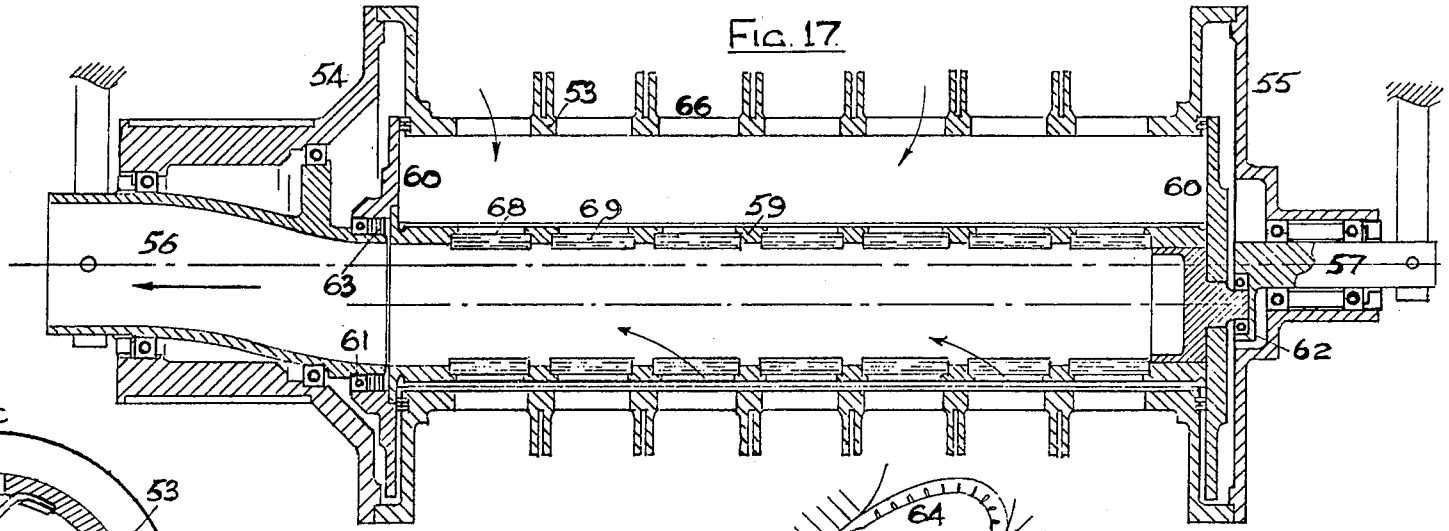
Figure 18:
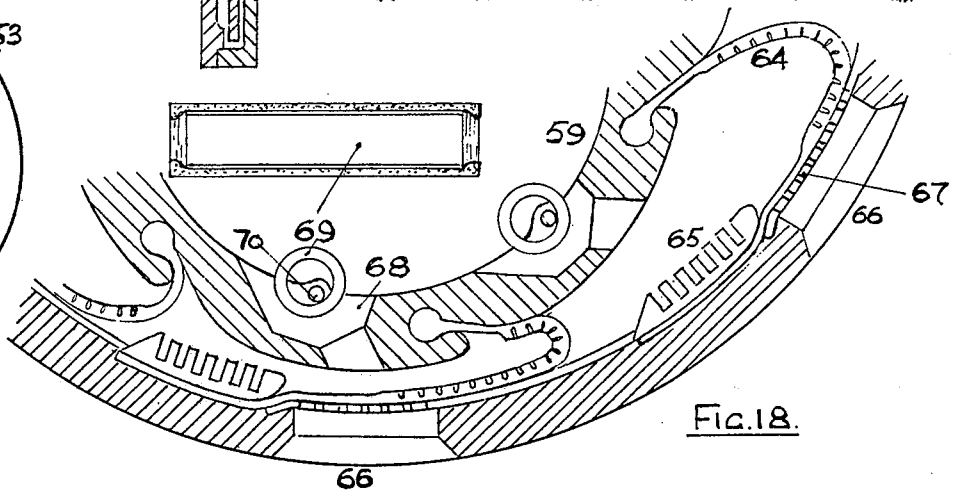
Figure 16:
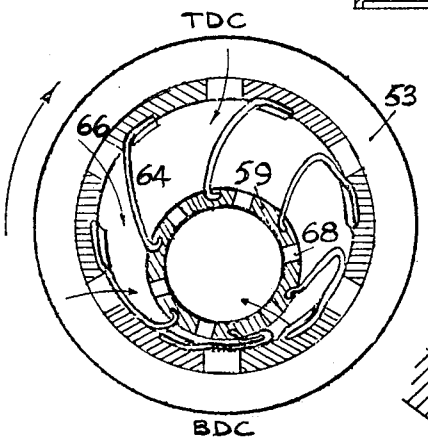
Figures 19, 20, 21, 22, 23, 24:
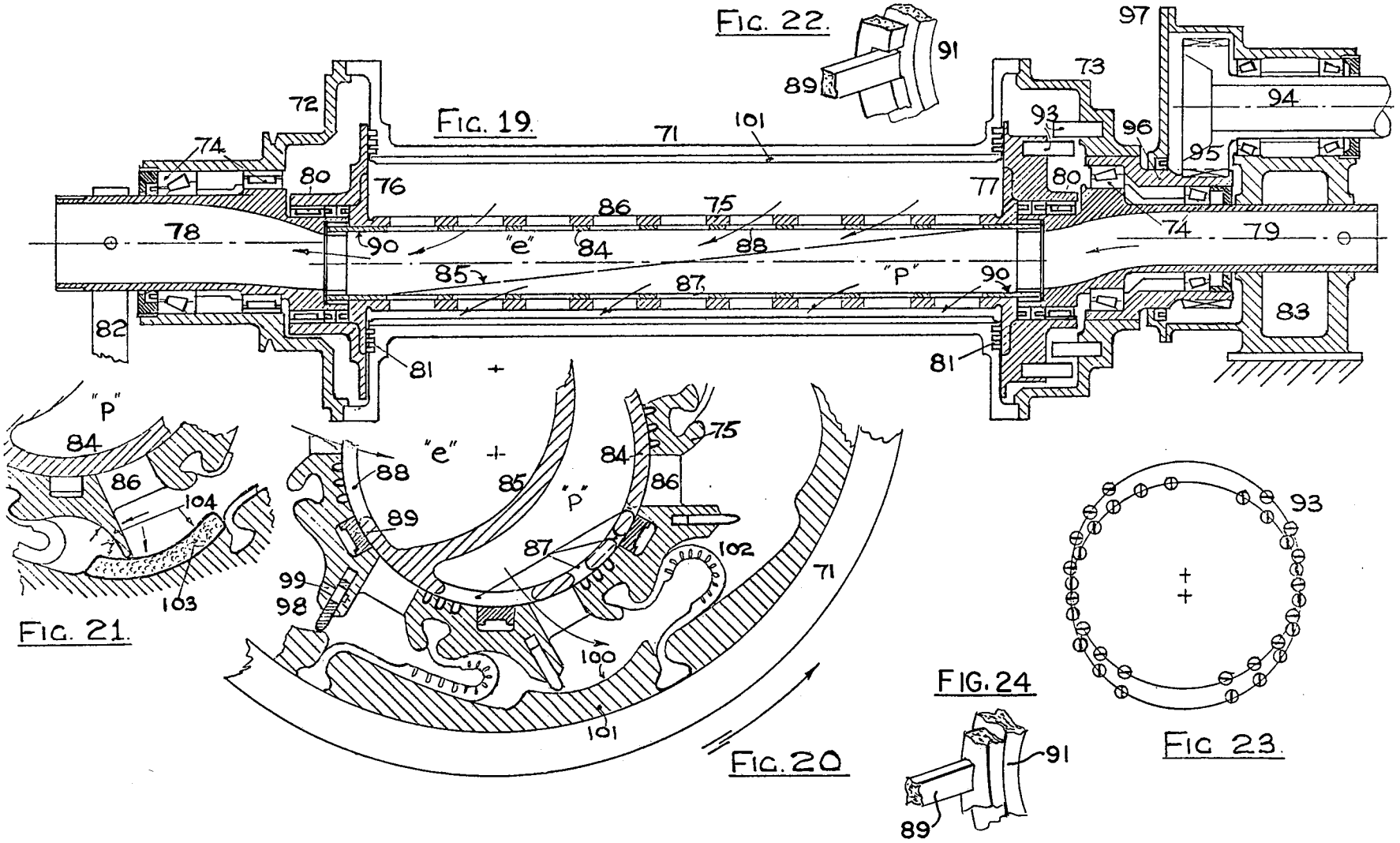

FIGS. 7 (*a*), (*b*) and (*c*) illustrate the possible disposition of a vane at three different relative positions of a cylinder and piston;

FIG. 8 is a cross-section through a machine according to the invention, adapted for use as a compressor, FIG. 9 is an elevation, partly in section, of the compressor of FIG. 8;

FIG. 10 is an enlarged detail of the compressor of FIGS. 8 and 9, at the BDC;

FIG. 11 is a side elevation of belt-controlled twin compressors;

FIG. 12 is a view of the intake region of the compressors of FIG. 11;

FIG. 13 is a view of the discharge region thereof;

FIG. 14 is a cross-section through an eye intake blower;

FIG. 15 is a longitudinal sectional elevation of the blower of FIG. 14;

FIG. 16 is a cross-section through a peripheral intake axle discharge blower;

FIG. 17 is a longitudinal sectional elevation of the blower of FIG. 16;

FIG. 18 is an enlarged detailed section of the blower of FIGS. 16 and 17, at the BDC;

FIG. 19 is a longitudinal sectional elevation through a vapour engine;

FIG. 20 is an enlarged detailed cross-section of the vapour engine of FIG. 19, at the BDC;

FIG. 21 is a similar view, of a modified vapour engine;

FIG. 22 is a schematic perspective view and illustrates the manner of sealing an inner sleeve to the piston shell in the engine of FIG. 19; and FIG. 23 is a schematic representation of peg gears for piston/cylinder timing;

FIG. 24 is a schematic perspective view similar to FIG. 22 wherein the sealing means between the inner sleeve and the piston is carried by the inner sleeve.

The arrangements of vanes, their attachments to piston and cylinder surfaces and their construction depend upon various factors, such as the working pressure differential, the working temperature, centrifugal forces and whether or not external gearing is employed. The free length and the number of vanes are dependent on whether or not the piston drive is imparted by the vanes themselves, the possible need for an overlap on peripheral intake ports and the space requirements for abutment devices. It is possible to arrange that, when the vanes are the piston drive medium, the pull is steady over sufficient of the rotation to ensure snatch-free operation even when the cushioning of centrifugal forces and pressure differentials is lacking, i.e. at low speeds. Also, by suitably shaping the surfaces of the piston and cylinder, the fold radius of a doubled vane in the BDC region can be maintained sensibly constant over some 40 degrees of rotation.

Where the vane edges slidably contact the machine end plates, and were leakage is to be avoided, some form of bead must bound the vane fabric to present a sealing/rubbing surface to the end plates. The bead must be stable and remain unbuckled as the vane folds and somust generally be subject to extension rather than compression. It must have a local surface condition providing the lowest possible frictional forces against the end plates associated with good wear characteristics and, preferably, be loaded by the pressure differential acting on the vane.

A simple lip protruding into the high pressure side of the inter vane compartment presents difficulties because of its tendency towards compression buckling and distortion, but a satisfactory alternative arrangement may be made by having the vane bead set on the back of the vane membrane, i.e. on the side of lower pressure and where, as the vane folds, small tension loads are developed within the bead.

Figure 1:
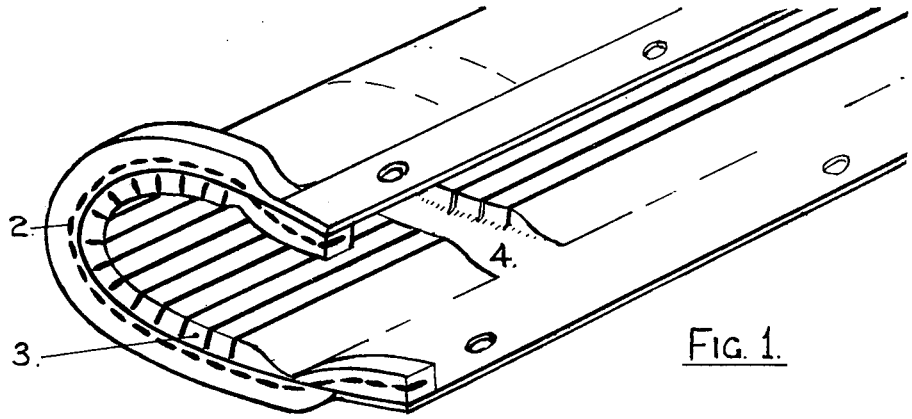
FIG. 1 shows, in a folded condition, one extremity and the adjacent part of a typical flexible vane with end beads and integral teeth.
Figure 2:
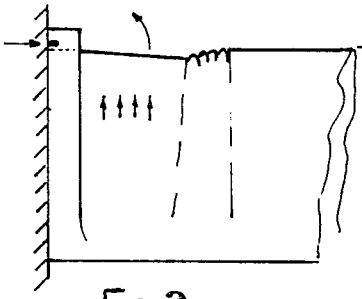
FIG. 2 shows the buckling produced by end plate constriction on a vane with excess length at the middle radial area, the vane being shown folded.
Figure 3:
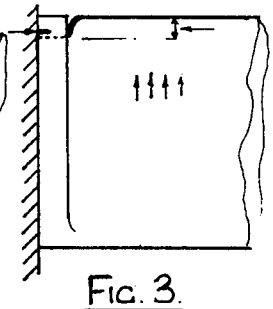
FIG. 3 shows the formation of a sealing lip by drape of bellied vane fabric over the end bead.
Figure 4:
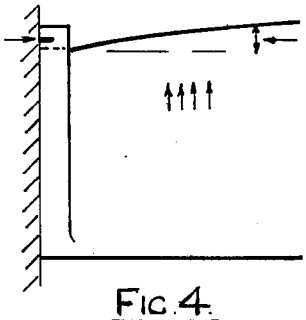
FIG. 4 shows how a similar condition arises from a less severe bellied shape to the vane and shows the axial pressure component stretching the vane outwards in an axial direction.
Figure 5:
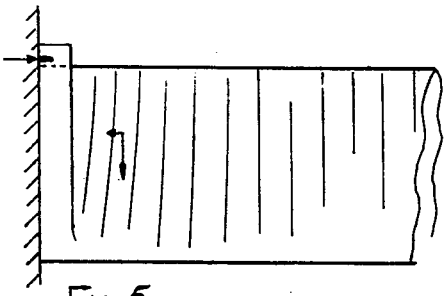
FIG. 5 shows the outward, axially directed loading to the bead set up by inclining the tensioned radial fibres of the vane fabric when those in the axial direction are stretchable.

There are various methods of arranging slidable forced contact of the vane against the end plate. The load carrying fabric can be formed in a variety of ways but the better methods depend upon a degree of longitudinal stiffness as may be supplied by the incorporation of battens or teeth. FIG. 1 shows a preferred construction where the external bead incorporates a low friction contact or rubbing surface of PTFE inserts 2. Teeth 3 are shown moulded in the elastomer with, howeve, a gap 4 in their continuity a short distance from the vane end. Attachments are shown as for saddle fixing to the piston and cylinder and the bead is accommodated by grooves in their surfaces. The crown portion of the vane has a longitudinal dimension slightly in excess of the end plate spacing so that, in the machine, the vane fabric is forced to buckle generally in the manner shown in FIG. 2, to concentrate at the discontinuity of the teeth, and it follows that, as the pressure differential builds up within the arch of the vane, forces are set up tto restore the shape, and this is reacted by the end plate loading to the bead so that the slidable contact loading is a function of tooth gap, buckling stiffness and pressure differential. As an alternative, FIG. 3 shows how, with the vane fabric cut to be a bellied form, the effect of a lip seal may be produced with an external bead. In practice, this effect can be simulated, as shown in FIG. 4, by a more gentle curvature in the vane fabric, the loading being transmitted to the bead by the battens, or teeth, as before. Now, the pressure loading on the vane is carried to the piston and cylinder surfaces by the radially disposed fibres of the fabric and, by arranging these fibres in an inclined form as shown in FIG. 5, it may be seen that the fibre tensions can provide longitudinal components tending to stretch the vane outwardly to load the bead against the end plates. Any of these mechanisms may be combined together, and further methods of maintaining contact between vanes and end plates may include the deployment of magnetic forces, inflatable sacs and the provision of a labyrinth type structure within the end bead to control the leakage rate without excessive frictional contact. In the case of very high temperature machines, such as steam expanders or hot gas engines the teeth, or battens, can be of metal or carbon, mechanically linked to form the vane matrix and the flexible sealant may be relieved of mechanical loading.

Various possible forms of attachment of the vanes to the piston and cylinder surfaces are generally depicted in the figures to follow, employing in some cases club ends in recesses and, in others, saddle type fixings.

Figure 6:
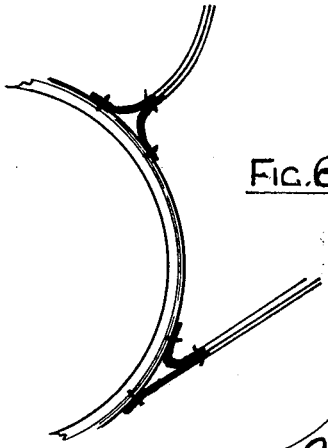
FIG. 6 shows a method of vane attachment to a fabric sleeve over the piston surface by means of sewing.

In high compression machines, with inter-vane chamber porting to the hollow piston axle, the thickness of the piston shell can greatly effect the compression ratio achieved and FIG. 6 shows a method of attachment of the vanes to the piston shell which permits a very thin tube to be used. In this example, the vanes are sewn to a fabric backing e.g. glass cloth, which is tightly wrapped over the piston shell and bonded under tension in such a way as high residual tensions remain and never wholly reduce to zero under van loading.

The centrifugal loading of the vanes is of prime significance to the modes of flexure even when pressure differentials are high. In order to control the shape, to some extent, and particularly to control the minimum bend radius, the vanes may have teeth, in the manner previously described. The teeth have no influence on the stiffness in one direction and when the vane is near straight but, as the radius reduces, and with the teeth projecting in to the bend, the gaps between the teeth are lost and butting commences to support compression forces. The effect is to establish a structural arch with compression across the teeth balanced by tension in the vane back, shear being resisted by inter-tooth friction. It can readily be seen that a definite radius of bend is appropriate to stiffness and folding forces and some control may be exercised by choice of material, the height of the individual teeth and the gaps between them. By such means, stresses may be kept to design bounds and the lay of the vane, under pressure and centrifugal forces, be predictable. Normally, although not requisite, the vane will be reinforced by a backing of fibrous material and the teeth will be of elastomeric material. In some designs, the teeth can have a hard core or, alternatively, a hard shell. The rubbing speed of the vane end against the chamber end plate has the value of some $2\pi$ eN cm per second, where "*e*" is the offset, in *cm*, of piston to cylinder axes and "N" is the rotational speed in revolutions per second, but there is an additional "flick" where the vane travels from the BDC to TDC positions. As the intervane pressures are small, at this part of the cycle, it can be advantageous to arrange for the lip loading on the end plates to be reduced and this may be done by dishing the end plates, when integral with the cylinder. It will be seen, by reference to FIG. 15, showing such provision, that, when the vane is near straight, its bead is pulled away from the radially curved end plate but, as it folds towards the cylinder surface, crushing of the piston end of the vane occurs and sealing is aided just where the differential of pressure is at its highest.

The pressure differential across a vane changes sign abruptly at BDC as in compression machines, discharge occurs to be followed immediately by intake. The same will occur in an expander, where exhaust is followed by pressure intake. At this point, the tendency is for reversal of vane curvarure and, whereas this can be resisted in part by the intertia of the vane mass, other means for its prevention are necessary in the more sophisticated forms of the invention. In the case of air motors and vapour engines, where the condition can exist with the machine at rest, or where any of the machines are of the fixed cylinder type, abutment must be positive without reliance on inertia. The invention includes several means of affording abutment, which may be employed separately or in combination. In the first place, where teeth are formed on the vane inner surface, they can be induced to butt hard against each other by the constraint of local cylinder and piston profiles and cause the vane locally to act as a rigid blocking arch at its fold. Any pressure excess from the convex side of the vane profile will cause increasing loads against the cylinder and piston surfaces and this will augment the frictional resistance to slip. Secondly, the vane teeth form a sort of labyrinth seal which may be taken as reinforcing other labyrinth shapes on piston or cylinder surfaces to perform the function of hindering flow beyond the discharge port and providing abutment at speed. This arrangement is illustrated by FIG. 18, and has the particular advantage of minimising the clearance volume. The third method may take a variety of detailed forms but may be taken to consist essentially of a blade, normally projecting from the piston and of the full axial length of the chamber, which is set to have sliding engagement with a local profile in the cylinder surface, for instance as in FIG. 20. Now, if the blade were very thin, this profile would be a circular arc of radius equal to the piston to cylinder offset but, in practice, the profile is distorted to accommodate the blade thickness. Alternatively, the blade may be formed off the cylinder and the near circular arc profile given to the piston. If the blade forms a perfect sliding seal, abutment is complete when the sealing is also maintained at the end plates. FIG. 21 shows an arrangement where a rigid, fixed blade engages in sliding contact with a flexible bed which is, typically, an elastomeric cushion, coated with a low friction film. As the blade traverses the bed, with nominal interference, the pressure changes form a wave in the resilient bed rising beehind the vane motion, to maintain either contact or a very close gap. Alternatively, in high speed machines, the maintenance of a close gap over a rigid bed may suffice. FIG. 20 shows a preferred scheme where the blade is arranged to slide within a housing from the piston and is loaded to engage with a rigid, low friction bed by centrifugal action and the mechanism of pressure drops as in the familiar piston ring.

The previous description has postulated means of preventing contacting doubling of the vane material but, in compression machines, the permitting of this to happen can lead to effective abutment, even though teeth be employed to limit fabric stress. FIGS. 7(*a*), (*b*) and (*c*) show a train of events, starting from the point (*a*) where pressure difference and centrifugal inertia flatten the vane fold. As the vane part lying on the cylinder is travelling faster than the piston anchorage, the inner layer of the doubled vane overtakes its piston attachment which peels the vane apart again, all without any sliding. Should teeth be a part of vane construction, they may be allowed to intermesh or, alternatively, be prevented from so doing by giving them a way or chevron run in the axial direction.

Fluid may be entrained or discharged through the cylinder periphery, through the chamber end plates or through a hollow piston and its axle, if any. Control may be arranged by slide or clack valves, operated by pressure differential or by the sensing of cyclic position in the manner of fixed shrouds or sleeves or by a mechanical train of cams or links. The chamber end plates may be part of the cylinder or part of the piston and this latter form is particularly suitable where porting is through the piston shell and ducting is through the axle interior. In another embodiment one end plate may be formed on the piston and the other on the cylinder. The chamber ends may also be formed as limp membranes connecting the vane ends with the piston and cylinder in a manner suitable for low pressure machines.

FIGS. 8, 9 and 10 illustrate a preferred form of the invention, which is a low pressure air compressor of high capacity. A hollow cylinder 5 has ports 6 cut in the periphery between vane attachements 7. The cylinder shell, which may be of any suitable material, is shown as a preferred construction of a wound glass reinforced plastics material where the primary windings 8 are laid in crossed helix and an infill 9 of resinated chopped strand laid between, the whole being covered in glass cloth. By this means, large cylinders may be constructed lightly and cheaply and, despite the long porting apertures, retain considerable torsional and flexural stiffnesses. End plates 10, contiguous with the cylinder shell, are radiussed or dished as shown at points 11 to increase vane end clearance during the intake part of the cycle and to constrain the vane axially near the BDC point. The cylinder is rotatable about bearings 12 and 13 carried by each of the hubs 14 and supported relative to the ground by stub axles 15 and brackets 16. Each stub axle carries a drop arm 17 containing a bearing 18 which supports a piston stub spindle 19. The piston is thus supported and rotates about an axis parallel to, but offset from, that of the cylinder, the spindles being carried on plate wheels 20 off the piston shell 21, also, typically, of a reinforced plastics material.

The stub axles 15 are prevented from rotating by the restraint of anchored levers 22 but, if these be capable of actuation, the piston axis may be set at various positions about the cylinder axis and relative to ground. A rigid shroud 23, which may be a reinforced plastic structure, is supported by tubes 24 attaching to the brackets and is fixed relative to ground. This shroud 23 (see especially FIG. 8) covers the cylinder closely over the compression part of the cycle and the beginning of the intake part to prevent leakage from ports 6, is open at the intake part 25 and formed as a duct 26 at discharge. The cylinder shell is coated with short pile carpet-like material 27 intended just to contact the shroud. This provides a self-cleaning labyrinth seal, over the shrouded region and at the cylinder ends, which will not be harmed by occasional rub. The cylinder is driven at each end by a toothed belt from a lay shaft (not shown) to prevent twist but, depending on the shell stiffness, the drive could, equally well, be from one hub only. The vanes 28 are shown as of toothed construction (see FIG. 10) to control the bend stresses and to provide abutment. The piston-vane attachments are by clamping, saddle plates 29 being bolted through the shell and of such a size as to minimise the clearance volume. The vane fixing at the cylinder shell is via clamps 30, sandwiched between the lay-up of the shell materials and bolted. The cylinder rotates clock-wise, as depicted by the feathered arrow in FIG. 8, and the piston is pulled round at the same speed by the vanes, the chambers "*a*", "*b*" "*c*" drawing in air to be compressed in chambers "*d*" and "*e*" for discharge. It is apparent that complete off loading of the cycle or adjustment to the discharge pressure can be effected by rotation of the stub axles under the control of the levers 22 to revolve the piston axis relative to the fixed shroud and its apertures. Blowers of this form can be very large, the speed of operation being limited only by the rub characteristics of the vane ends.

FIGS. 11, 12 and 13 depict two such blowers coupled together by a flat belt where this and two further belts take the place of the fixed shroud 23. In the elevation, FIG. 11, the dual machine is divided, the left hand part being open to atmosphere and shrouded by the endless belt 31 to allow air intake from the space between the two cylinders. The right hand part is enclosed in a box 32 and the cylinder shells each are partly enshrouded by belts 33 which constrained by idler pulleys 34 and 35, define discharge openings 36. The box then collects the discharge to be exhausted via duct 37. This arrangement of belt shrouds allows for complete sealing with low friction and, althrough the external drive is shown as being transmitted to a pulley 38, any of the idlers could be the driven part. The cylinder shell has a sealing flange 39 at the entry to the box.

The blowers so far described in connection with FIGS. 8 to 13 have the end plates, as part of the cylinder, cut at their centres to allow passage of the stub axles. In FIGS. 14 and 15 an arrangement is shown for a blower where the end plate aperture is enlarged to allow for intake of ambient air to the eye of the machine. The discharge is shown to be ported via holes 40 in the piston shell 41 to openings 42 in the fixed, hollow axle 43 which is extended to carry bearings 44 on which the piston spigot 45 can ride. Ring type seals 46 seal across the piston ends to the end plates 47 integral with the cylinder 48 which, in this illustration, is supported entirely by the motor shaft 49. The end plates are dished near to the cylinder rim to provide clearance during ingestion to the vane edges 50. The intake aperture 51 is partly closed by a fixed plate 52 grown from the hollow axle.

It has already been stressed that the rotary motions of cylinder and piston are synchronous and that the piston axis, relative to the cylinder, orbits about a radius equal to the axes offset. It is then clearly possible to have a piston mounted end plate embodying ports controlled by a cylinder mounted plate overlapping and in close contact so that, by suitably porting the cylinder plate also, intake and discharge can be selected. However, such arrangements suffer from the smallness of ports relative to the swept volume.

It is possible to arrange many variations of piston to cylinder offset ratios and there is some latitude in vane length choice, especially if gearing is introduced to effect piston and cylinder synchronisation, and, to use longer vanes to advantage a further method of porting is shown in the large blower of FIGS. 16, 17 and 18 where advantage is taken of vane wrapping over the cylinder surface to close peripheral intake ports in the cylinder shell during gas compression. Discharge is via a hollow portion, ported through non-return valves. Piston-mounted chamber end plates permit a generous duct.

An aluminium cast cylinder 53, finned for cooling, is bolted to hubs 54 and 55 which support a hollow stub axle 56 at the discharge end and a more simple, cranked stub axle 57 at the other, on tandem bearings. Both stub axles are pinned to ground support brackets. A hollow piston 59, typically an investment casting in steel, is screwed to end plates 60 to make up an assembly which is free to rotate on bearings 61 and 62, also carried by the stub axles, about an axis offset from but parallel to that of the cylinder. The piston is blanked at the one end and open at the discharge part to align with the bore of the fixed cranked, hollow axle 56, seals 63 preventing gas leakage to the hub interior or oil leakage from the hub bearings. Hub 54 is grooved to mate with a multi-V-type belt drive. The vanes 64 are shown to be of toothed construction with a club end attachment to the piston shell and a bolted clamp from saddle 65 at the cylinder. The intake ports 66 are cut in the cylinder shell just behind the vane attachments and, to support the vanes when they cover the ports perforated metal covers 67 are riveted to the shell. The compressed gas is delivered through ports 68 in the piston shell under the control of valves opened by the pressure differential across them. In the drawing, these valves are depicted as light tubular, rubber coated slugs 69 restrained by wires 70 and bedding in to the grooves 68 cast in the piston. The necessary spring loading is not shown. Alternatively, the ports can be closed by simple spring leaves. Experiment has shown that, for a machine of this form working against low back pressure, these valves can be made more effective if the promptness of their closing is ensured by mechanical means such as a cam gear.

The blower, so far described, is suitable for discharge against pressures of some 30 p.s.i.g. Compressor design to work against higher pressure may follow the pattern of FIGS. 19 to 23, which depict a vapour engine as the expander in a Rankine cycle. This is similar in many respects to the blower and, again, is shown as a rotary machine, with anti-clockwise rotation this time, but could, equally well, be of the fixed cylinder type with driving axles. Diferences from this expander form when the machine is used as a compressor would comprise changes to the axle sleeve ports and the provision of cooling fins to the cylinder shell, the insulating lining to the cylinder being replaced by a conductive layer.

Referring again to the drawings, FIG. 19 shows the sectioned elevation of the expander in which the cylinder shell 71, typically of cast aluminium alloy, is bolted to the hubs 72 and 73 which run on the tandem bearings 74. The piston shell 75, suitably an investment casting in stainless steel, is bolted to end plates 76 and 77 which are supported from the stationary stub axles 78 and 79 by bearings 80 locally sealed against gas and oil leakage, the hubs containing a quantity of oil for the mist lubrication of all bearings. The end plates are sealed against gas and oil leakage at their junction with the cylinder rim by rings 81, housed in the cylinder. The end plate surfaces are coated with a low friction material best compatible with the friction characteristics of seals and vanes, e.g. carbon -ptfe mixes, as in the blower previously described. The stub axles are hollow, e.g. cast from iron, and are rigidly held against rotation, but with minimum fixation against bending, by bracket 82 and rigidly in bending too by the pedestal 83 at the drive end. Stub axle 78 is the exhaust pipe to condenser and the smaller bore axle 79 is the high pressure line. The two stub axles are bridged, inside the piston shell, by a sleeve 84, typically a welded steel assembly, splined to the stub axles to prevent rotation but retaining a degree of axial float. Within the sleeve, which is a loose fit inside the piston shell, a division 85 is constructed as a diagonal member curved inwards towards the greater volume of the sleeve to maintain good flow characteristics and prevent distortion of the sleeve from the effects of temperature changes. In FIG. 19 the run of the division 85 is shown diagrammatically to delineate the pressure and exhaust sides of the sleeve. FIG. 20 illustrates the true position. Pressure vapour, entering from 79, is ported through open holes 86 in the piston shell by the timing of ports 87 in the sleeve and exhaust is similarly ported via the slot 88 in the other part of the sleeve, as divided by 85, and marked "*e*" in the drawings to differentiate against the pressure side "*p*". Sealing between inter-vane chambers is effected by carbon / ptfe bars 89 working with the mechanism of the familiar piston ring in slots formed in the piston shell and pressurised to contact the stationary surface of the sleeve. At positions 90 in FIG. 19, sealing rings 91, shown enlarged in FIG. 22, housed in annular slots in the piston shell, complete the sealing of the bars and, further, prevent gas escape from the sleeve ends. The rings may be of carbon / ptfe and run dry of oil. It is to be understood that the bars 89 may equally as well be mounted in slots formed in the sleeve 84 and sealed at their ends by sealing rings 91 which are housed in annular slots in the sleeve 84. Such a general arrangement is shown in FIG. 24.

Because of the nature of the abutment means, to be described, gearing of the cylinder and piston motions is desirable and one such mechanism to effect timing is shown in FIGS. 19 and 23. This comprises hardened steel pegs 93 set regularly on identical pitch circles about the cylinder and piston axes in hub 73 and end plate 77, to intermesh so that drive is transmitted at the cusp points of the geometry. Although there is sliding contact between the pegs, the loads are very small and adequate lubrication is provided from the oil mist generated in the hub.

Drive may be taken off the engine in a variety of ways, one, which is suitable for light vehicle power, being from twin belts off the cylinder surface e.g. broad Multi Vee units, picking up pulleys at the vehicle half shafts to drive the wheels through reverse and reduction gears. Because the expander has the variable torque characteristics of the reciprocating vapour engine, the need for a multi-speed gearbox is unlikely. In FIG. 19, drive is shown as by shaft 94 running on taper roller bearings housed in the fixed pedestal 83 and with helical gear 95 meshing with the gear 96 pinned to hub 73, the whole being housed in cover 97 integral with the pedestal 83 and sealed.

Because complete sealing, at abutment on BDC, is necessary in the static conditions, no help can be gained from any labyrinth effects and, in FIG. 20, an arrangement is shown where a sliding blade 98 is free to extend within the limitation of the retaining pegs 99 to rub on a bed 100 formed on the cylinder surface or, more particularly, on the surface of an insulating lining 101. Were the blade to be of very small thickness, this surface would be a circular arc of radius equal to the piston-to-cylinder offset. In practice, the arc is modified to suit the blade employed The blades are of the full length of the piston and in contact with the end plates and, under centrifugal and pressure forces, impinge on the beds 100 as BDC is approached and sweep the contact area before lifting off at the beginning of the expansion stroke. The vanes 102 are of toothed construction, typically in silicone rubber reinforced by carbon fibre, and, because of the geared motions of piston and cylinder, are shorter than shown in the machines of earlier Figures. They roll onshaped surfaces of both piston and cylinder to present a uniform fold radius over a substantial part of they cycle at near BDC so that the arch effects, previously described, can work to the full and assist, by the resistance to pressure differential, the abutment mechanism of the blades. Again, there are many variations possible and FIG. 21 is an illustration of how the sliding blade may be replaced by a fin, off the piston shell, which engages with a resilient bed 103. This bed is a mattress of soft elastomer, covered with flexible material of low friction characteristics and, without pressure effects, the blade 104 would interfere with its surface. The effects of the pressure differential across the blade is to depress the bed on the high pressure side, to the right of the blade in the Figure, which induces a pressure wave in the elastomer to cause it to rise behind the blade i.e. to the left hand side and form a ramp so increasing the effective interference.

The inlets ports in the sleeve 84 consist of a main opening, effective at the start of the expansion part of the cycle, and smaller holes in retard. These latter ports are self-throttling at speed and ineffective but come in to play at start and low speeds to delay pressure cut-off and increase torque. The same function can be obtained by having a larger main port which can be partly covered by a slipper internal to the sleeve and in sliding engagement with it. Adjustment to the port size may be effected on rotation of the slipper as a slide valve and this action may be controlled manually or by pressure difference across the divider 85.

This machine may, alternatively, be of the static cylinder type with drive off the then free axles.

There are several types of rotary machine already well developed and serving as low pressure fans, blowers, compressors and air motors. In the case of the Roots type blower, noise and low efficiency are drawbacks and with the larger sliding vane compressors, the need for oil flooding for the sealing of vane edges precludes their use for certain processes, even when elaborate devices are employed to remove the oil from the discharge. In machines according to this invention, the geometry permits a variety of arrangements and a very high fluid throughput. The cycle is one of internal compression, or expansion, at high available ratios and, because the seal and vane end rubbing speeds are low and across a changing surface, the machines can be oil free within the working chambers. As compressors, the machines are self-cooling to some extend as results from the rotation of the cylinder in free air and the parts under maximum compression are constantly changing. Also, the construction is largely independent of precision methods and can result in low cost, low weight and low bulk. When the invention is extended to the vapour engine derivative, on a Rankine cycle, the oil-free working, the low heat transfer the internal expansion and the simple torque control make for a simple, quiet and low pollution means of heavy vehicle power, and this type of engine can show many economies in first cost and in running costs too on present fuel prices. It presents opportunity for exploitation of new fuels and, particularly, the freedom from oil permits a closed evaporator-condenser cycle perculiar, for an expander with internal expansion, to the present invention. Only in very recent times have the necessary low friction materials and high temperature elastomers become available to permit the proper and pratical working of the machines of this invention.

What I claim is:

1. A rotary machine for selectively providing internal compression or expansion to a fluid and selectively connectable to a driving or driven shaft, said rotary machine comprising a cylinder rotatable about its axis, a piston within the cylinder rotatable synchronously with the cylinder about an axis parallel to but offset from the axis of rotation of the cylinder, cylinder end boundaries between said piston and said cylinder, a series of flexible vanes each constructed from elastomerically coated fibrous material spanning the gap between the inner surface of the cylinder and the outer surface of the piston and controlled in deflection by geometrical and pressure changes each of which is without recourse to liquid additives in sealable rubbing contact with said cylinder end boundaries and sealably connected to the surfaces of said cylinder and said piston, each vane sweeping the space between said cylinder and piston surfaces and said cylinder end boundaries, each pair of adjacent vanes defining with the said cylinder and piston surfaces a chamber for a fluid medium which during each revolution of said cylinder varies in volume to selectively compress or expand fluid ingested and exhaust it from said rotary machine, each of said vanes having a concave surface and a convex surface, each of said vanes being provided with adjacent spaced projections formed on the concave surface of each vane so that as the vane folds or bends said adjacent projections butt one another and resist further bending of the vane and where an arch so formed bridges the minimum gap between the said cylinder and piston surfaces to form an abutment against fluid loads acting on the convex surface of said vane, and said vane having edges provided with a low friction dry rubbing surface at their contact with said cylinder end boundaries.

2. A rotary machine as claimed in claim 1 wherein each vane has edge beads at the opposite ends thereof and said adjacent projections are interrupted near to said edge beads to provide an area of soft membrane free to buckle under the constraint of said cylinder end boundaries when the vane is initially longer than the spacing of said cylinder end boundaries so that under pressure the restitution of the distortion generates an outward load on a short length of said adjacent projections adjacent to said edge beads to ensure a sealing contact between said beads and said piston end boundaries as a function of pressure loading across each vane.

3. A rotary machine as claimed in claim 1 wherein said piston and cylinder are coupled together for simultaneous rotation by a train of drive elements mounted on said piston and cylinder.

4. A rotary machine as claimed in claim 1 wherein said piston and cylinder are coupled together for simultaneous rotation by the meshing of drive elements mounted on a wheel concentric with said cylinder axis and on a wheel concentric with said piston axis.

5. A rotary machine as claimed in claim 1 wherein said piston and cylinder are coupled together for simultaneous rotation, a pair of wheels of equal pitch circle diameter, one of said gear wheels being concentric with said cylinder axis and the other of said gear wheels being concentric with said piston axis, drive being transmitted between said wheels by the meshing at wheel cusp points via axially disposed cantilevered pegs carried by said wheels.

6. A rotary machine as claimed in claim 1 wherein said cylinder end boundaries are formed by plates connected to said cylinder and in sealed contact with said piston.

7. A rotary machine as claimed in claim 1 wherein said cylinder end boundaries are formed by plates connected to said piston and in sealed orbital contact with opposite ends of said cylinder.

8. A machine has claimed in claim 1 wherein the length of the vane in a radial direction is reduced progressively from the axial mid position towards the ends.

9. A machine as claimed in claim 1 wherein the ends of the vanes are shaped to form labyrinth seals with the end boundaries.

10. A rotary machine as claimed in claim 1 wherein the vanes are attached to the piston and cylinder by means of beads formed on the vanes and being housed in slots in said piston and cylinder.

11. A machine as claimed in claim 1 wherein the vanes are sewn to a layer of fabric which is adhered to the piston.

12. A machine as claimed in claim 1 wherein lips are formed on the vanes at the ends thereof contacting the end boundaries of the cylinder.

13. A machine as claimed in claim 12 wherein the lip is formed by the vane material loosely overlapping a bead formed at the end of the vane.

14. A rotary machine as claimed in claim 1 wherein there is a minimum gap between surfaces of said piston and cylinder, and there is an additional abutment across said minimum gap between said piston and cylinder surfaces maintained by a blade radially projecting from said piston surface and sliding in axially disposed slots in said piston and butting against said cylinder and boundaries with an outer edge, said blade being forced outward by centrifugal and pressure forces to sweep an arc shaped bed formed in the inner surface of the cylinder in a sealable manner, there being at least one of said blades in each of said chambers.

15. A rotary machine as claimed in claim 14 wherein said beds formed in said cylinder inner surfaces are each coated with a low friction skin supported by a subcutaneous layer of resilient material deformable under pressure to provide a wave form rising in advance of the blade motion to further close said gap.

16. A rotary machine as defined in claim 1 wherein said vane is formed of a synthetic elastomer enriched with a low friction additive.

17. A machine as claimed in claim 16 wherein the low friction additive is carbon, polytetrafluoroethylene or molybdenum disulphide.

18. A rotary machine as claimed in claim 1 wherein said piston is in the form of a shell having an inner surface, ports formed in said piston shell, in rubbing contact with said piston shell inner surface, a fixed inner sleeve, said fixed inner sleeve having ports which at preselected positions in the movement of said piston shell register with said piston shell ports to permit controlled passage of fluid from the piston outer surface to the inner part of said fixed inner sleeve.

19. A rotary machine as claimed in claim 18 wherein said fixed inner sleeve is partitioned so that inward flow of fluid through said ports is directed through one end of said fixed inner sleeve and outward flow of flow is directed through the other end of said fixed inner sleeve.

20. A rotary machine as claimed in claim 19 wherein there is a gap between said piston shell inner surface and an outer surface of said fixed inner sleeve and said gap is sealed for the segregation of flow from certain of said ports and from leakage to the outside of said rotary machine by boundaries made up by transverse sliding bars housed within slots in the outer part of said fixed inner sleeve and butting against rings housed in annular slots at the ends of said fixed inner sleeve, said bars and rings being formed of dry low friction material and being pressure loaded against said piston shell inner surface.

21. A rotary machine as claimed in claim 20 wherein said bars and rings are alternatively housed in slots formed in said piston shell and rub against the outer surface of said fixed inner sleeve.

* * * * *